US005499467A

United States Patent [19]

Kuznetsov et al.

[11] Patent Number: 5,499,467

[45] Date of Patent: Mar. 19, 1996

[54] INFORMATION DISPLAY STAND

[76] Inventors: Edward S. Kuznetsov; Maxim E. Kuznetsov, both of 27 Revolution Hwy., Apt. 41, St. Petersburg 195176, Russian Federation

[21] Appl. No.: 409,415

[22] Filed: Mar. 24, 1995

[51] Int. Cl.[6] ..... G09F 11/02

[52] U.S. Cl. ..... 40/504; 40/506; 446/171

[58] Field of Search ..... 40/504, 493, 494, 40/503, 506; 446/171, 172, 173, 168

[56] References Cited

U.S. PATENT DOCUMENTS

| | | | |
|---|---|---|---|
| 1,260,664 | 3/1918 | Gregory | 446/171 |
| 1,279,271 | 9/1918 | Cole | 446/173 |
| 2,785,504 | 3/1957 | Koolstra, Sr. | 446/173 |
| 2,801,054 | 7/1957 | Bach | 40/504 X |
| 2,850,821 | 9/1958 | Warren | 40/506 |
| 3,592,471 | 7/1971 | Swimmer | 446/168 X |

*Primary Examiner*—Kenneth J. Dorner
*Assistant Examiner*—Cassandra Davis

[57] ABSTRACT

An information stand with a plurality of faces which are successively exposed to a viewer. The stand has a rigid hollow frame within which one or more multi-face information carrier elements are positioned. The frame has a pair of unequal in length parallel vertical sides and inclined upper and lower parts. Each of the information carrier elements is fixedly attached to a rotational shaft. A plurality of lever arms extend in a symmetrical relationship from the shaft, each of the lever arms being fixedly attached, at one end, to the shaft. A free end of each of the lever arms is intermittently received within a shorter side of the frame. A weight descends under gravity within the shorter side and contacts the free end of the lever arm, imparting rotation on the lever arm, the shaft and the information carrier element. A powered drive lifts the weight within the longer side of the frame, from where the weight moves again under gravity to cause rotation of the information carrier element.

10 Claims, 1 Drawing Sheet

INFORMATION DISPLAY STAND

BACKGROUND OF THE INVENTION

The invention relates to display stands, and more particularly to a stand suitable for displaying periodically changeable data. Advertising and information stands adapted to displaying variable data have long been widely used by product manufacturers, providers of different services, newspapers and other media.

Such stands often utilize rotationally mounted elements, with each element being mounted for rotation independently from adjacent elements. For example, European patent No. 0431763 issued in 1991 discloses an information stand provided with a number of periodically rotatable driving plates which are designed to display one or more views. Each plate has its own register associated with a clamping device.

Another example of an information stand is shown in USSR Author's Certificate No. 1406629 issued in 1986. That document discloses an apparatus comprising a number of successively mounted trihedral prisms, each mounted on a rotational driving shaft. An endless flexible display data carrier is mounted about its corresponding prism and is secured thereto by resilient plates and clamps engaging the face of the prism.

These and other similar display stands suffer from a number of disadvantages, such as structural complexity and the need for a relatively powerful driving force required to turn the data carriers.

Still further example of a display stand is shown in USSR Author's Certificate No. 943823 issued in 1980. That stand utilizes a number of successively mounted trihedral prisms adapted for rotation about a longitudinal axis. The apparatus provides for the use of shaft-mounted sprockets and a single driving unit connected by a pair of roller chains. This stand has a complex construction requiring the use of a plurality of rotational sprockets, locking elements, a complex drive unit with a complicated system of a number of roller chains. The weight of the chains makes it necessary to use an increased power drive unit which, in turn, requires a greater source of power. In order to fix the stand in a working condition, it is necessary to use a servo drive or an electromagnetic clutch which opens a power kinematic circuit. These features make it impossible to use such a stand with a small independent power source, therefore making it extremely difficult to utilize the stand for advertising purposes.

The present invention contemplates elimination of drawbacks associated with the prior art and provision of an improved information stand.

SUMMARY OF THE INVENTION

It is, therefore, an object of the present invention to provide an improved information stand which can be powered by a relatively small independent power source.

It is another object of the present invention to provide an information stand which can successively display various data by rotating data carriers in a synchronized manner.

It is a further object of the present invention to provide an information stand, wherein the information carrier is rotated by a weight descending under gravity within a rigid frame.

These and other object of the present invention are achieved through a provision of an information stand which comprises a rigid hollow frame having a pair of parallel vertically oriented unequal in length sides, an upper part and a lower part connected to one of the sides at an obtuse angle. One or more information carrier means, which can be in the shape of a trihedral prisms, are mounted within the frame.

Each of the prisms is fixedly attached to a rotational shaft which also carries a plurality of lever arms symmetrically spaced from each other. One end of the lever arms is fixedly attached to the shaft, and a free end of each arm is intermittently received within a shorter side of the frame.

A weight, for example a heavy ball, moves along the inclined upper part of the frame and descends, under gravity, inside the shorter side of the frame. The ball contacts the free ends of the lever arms forcing them to move within the shorter side of the frame and transmit the rotational movement to the shaft and the information carrier. As a result, the information carrier is rotated exposing a different face to a viewer.

The ball then moves, still under gravity, inside the inclined lower part of the frame until it rests on a contact plate mounted in a corner which joins the longer side of the frame and the lower part.

A battery-operated power drive is activated and moves the ball upwardly, towards the upper part of the frame, where the ball is allowed again to slide towards the shorter side of the frame and repeat the cycle.

BRIEF DESCRIPTION OF THE DRAWING

Reference will now be made to the drawings, wherein like parts are designated by like numerals, and wherein.

DETAIL DESCRIPTION OF THE PREFERRED EMBODIMENT

Figure 1:
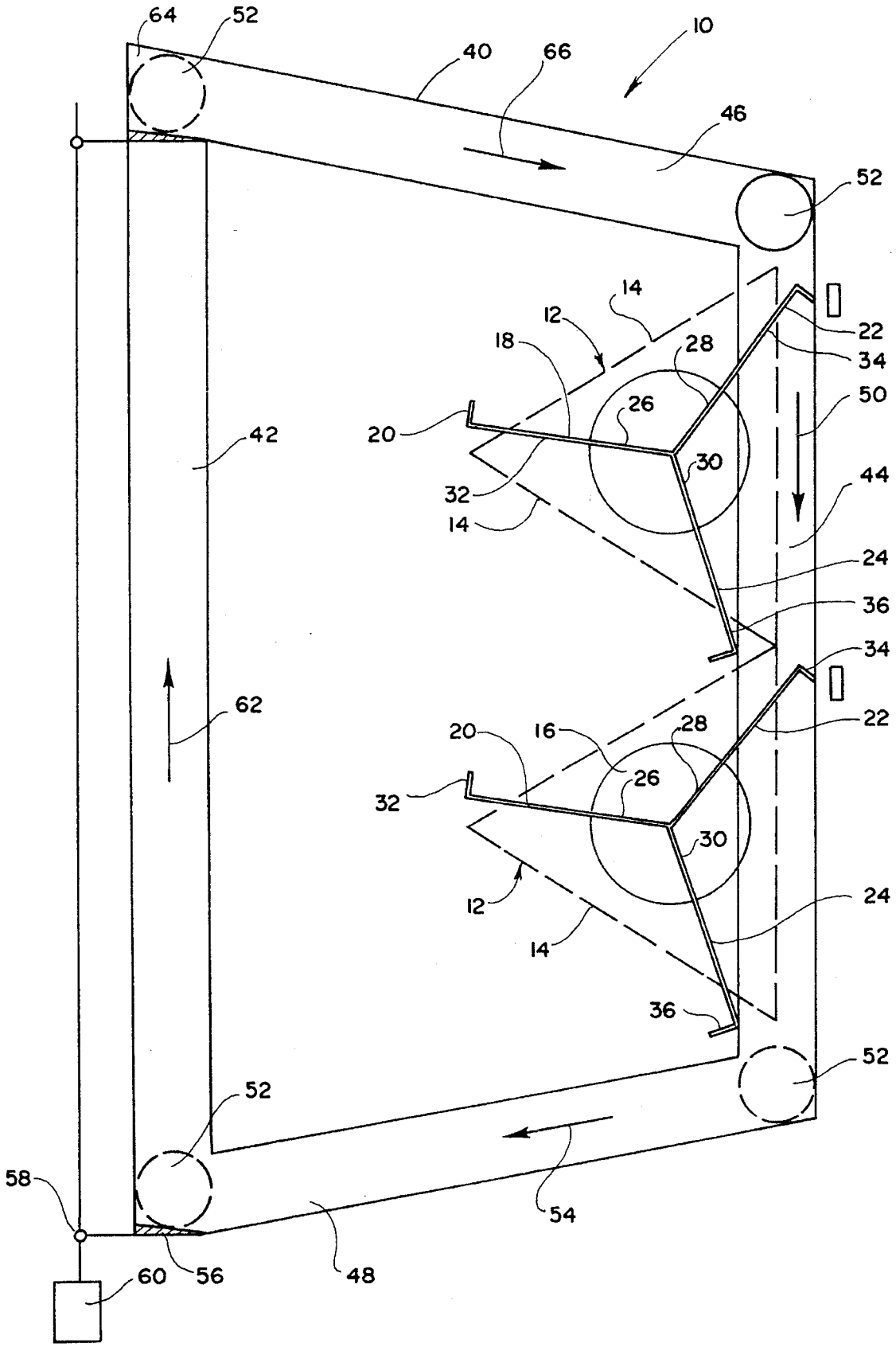
FIG. 1 is a schematic view of the apparatus of the present invention.

Referring to the drawings in more detail, numeral 10 designates the apparatus in accordance with the present invention. The apparatus 10 comprises at least one multi-faced information carrier means, shown as a trihedral prism 12 (two such prisms are shown in FIG. 1), having exterior faces 14. The faces 14 are adapted for displaying various data required by the user.

Each prism 12 is rotationally mounted on a separate shaft 16 and is operationally connected to a system of lever arms 18. The system 18 comprises three L-shaped lever arms 20, 22 and 24 which are fixedly connected to the shaft 16 and extend at symmetrically spaced relationship therefrom, that is at 120 degrees to each other.

When the arms 20, 22 and 24 are moved, the shaft 16 is forced to rotate along with the shaft arms 20,22 and 24 as will be explained in more detail hereinafter.

Each of the lever arms 20, 22, and 24 comprises a first end 26, 28, 30, respectively, which is connected to the shaft 16 and a free end 32, 34, 36, respectively.

The apparatus 10 also comprises a rigid frame 40, which has a pair of un even in length parallel vertical sides 42 and 44 connected by inclined upper part 46 and inclined lower part 48. The side 44 is smaller in length than the side 42, so that the upper part 46 and the lower part 48 are oriented at an obtuse angle in relation to the side 44.

The side 44 extends in such close proximity to the prism(s) 12 as to successively receive the free ends 32, 34, or 36 of the lever arms within a guiding track, or slot 50 which is formed in the side 44 of the frame 40.

A ball-shaped weight 52 (shown in solid lines in the upper right corner of the frame 40 and in phantom lines in the other three corners of the frame) falls, under gravity, from the uppermost portion of the side 44 down to the lowermost portion of the side 44, moving within the cavity of the track 50 and alternatively contacting the free ends 32, 34, or 36 of the lever arms. When the weight 52 contacts a free end of the lever arm, it pushes the lever arm and causes it to rotate in a clockwise direction.

This torque is transmitted to the shaft 16 and to the prism(s) 12 forcing the prism to turn about the axis of the shaft 16 by 120 degrees and expose another face 14 along with the information which that face carries to a viewer.

The weight 52 then slides, under gravity, along the lower part 48 of the frame 40, as shown by arrow 54, and comes to a stop on a contact plate 56 of a lifting mechanism 58. The lifting mechanism is operationally connected to and is powered by a drive 60. The signal from the contact plate 56 is transmitted to the drive 60 causing its activation.

Power generated by the drive 60 is sufficient to move the weight 52 upwardly along the side 42 of the frame 40 as shown by arrow 62. Once the weight 52 is positioned in the uppermost corner 64 of the frame 40, it is allowed to slide, under gravity, in the direction of arrow 66 within the upper part 46 of the frame 40 to its initial position in top end of the side 44. The cycle of rotating the lever arms and the prisms is repeated.

The information stand of the present invention is simple in construction, utilizes minimum of moving parts. The only power required to lift the weight 52 can be supplied by a battery or by a wind-powered drive which allows to position the stand 10 at a location removed from electrical power lines. As a result, the apparatus of the present invention can find its application in remote locations where access to electrical power is impossible.

If desired, the turning of the prisms can be enhanced by light and sound effects. Many changes and modifications can be made in the design of the present invention without departing from the spirit thereof. We, therefore, pray that our rights to the present invention be limited only by the scope of the appended claims.

We claim:

1. An information stand, comprising:

a rigid hollow frame having a first vertical side, a second vertical side oriented in a substantially parallel relationship to the first side, an upper part and a lower part connecting said first and said second vertical sides, said upper part and said lower part being mounted at an obtuse angle to said second side;

at least one multi-face information carrier means positioned adjacent said second side, said information carrier means being fixedly attached to a rotational shaft;

a means for intermittently rotating said shaft, said rotating means comprising at least one lever arm extending outwardly from said shaft so that a free end of the lever arm extends into said second side;

a means slidably mounted within said frame for imparting rotational force on said free end of the lever arm, thereby causing rotation of said shaft and said at least one information carrier means so that a different face of said at least one information carrier means is intermittently exposed to a viewer.

2. The apparatus of claim 1, wherein said means for imparting rotational force comprises a weight which falls, under gravity, within said second side and contacts said free end of the lever arm.

3. The apparatus of claim 2, further comprising a power means for lifting said weight and moving the weight upwardly inside said first side.

4. The apparatus of claim 3, wherein said power means comprises a contact plate mounted in a corner of said frame which joins said first side and said lower part.

5. The apparatus of claim 1, wherein said at least one information carrier means comprises a trihedral prism.

6. The apparatus of claim 1, wherein said rotating means comprises a plurality of symmetrically spaced L-shaped lever arms, each of said lever arms having a first end, which is fixedly attached to said shaft, and having a second end which is successively engaged in said second side of the frame.

7. The apparatus of claim 2, wherein said weight moves under gravity within said upper part and said lower part.

8. An information stand, comprising:

a rigid hollow frame having a first vertical side, a second vertical oriented in a substantially parallel relationship to the first side, an upper part and a lower part connecting said first and said second vertical sides, said upper part and said lower part being mounted at an obtuse angle to said second side;

at least one multi-face information carrier means positioned adjacent said second side;

a rotational shaft fixedly connected to said information carrier means;

a means for intermittently rotating said shaft and said at least one information carrier means, said rotating means comprising a plurality of symmetrically spaced lever arms, each of said arms having a first end which is fixedly connected to said shaft and a second, free end which is intermittently received within said second side;

a weight means slidably movable within said frame and successively contacting a free end of each of said lever arms, thereby causing rotation of said shaft and said at least one information carrier means so that a different face of said at least one information carrier means is intermittently exposed to a viewer.

9. The apparatus of claim 8, further comprising a power means for lifting said weight means and moving the weight means upwardly within said first side, said contact plate being provided with a contact plate mounted in a corner of said frame which joins said first side and said lower part.

10. The apparatus of claim 8, wherein said weight means moves under gravity from said upper part to said second side and descends under gravity within said second side while contacting a free end of each of said lever arms.

* * * * *